US009027475B2

(12) United States Patent
Rousseau et al.

(10) Patent No.: US 9,027,475 B2
(45) Date of Patent: May 12, 2015

(54) METHOD FOR CHANGING EDITION ON A ROTARY PRESS

(75) Inventors: Nicolas Sebastien Rousseau, Cinqueux (FR); Christophe Jean Olivier Noiret, Saint Leu d'Esseurent (FR); Christophe Maurice Lambert, Saint Maure (FR)

(73) Assignee: Goss International Montataire SA, Montataire (FR)

( * ) Notice: Subject to any disclaimer, the term of this patent is extended or adjusted under 35 U.S.C. 154(b) by 475 days.

(21) Appl. No.: 12/863,557

(22) PCT Filed: Jan. 14, 2009

(86) PCT No.: PCT/FR2009/050049

§ 371 (c)(1), (2), (4) Date: Sep. 14, 2010

(87) PCT Pub. No.: WO2009/092962

PCT Pub. Date: Jul. 30, 2009

(65) Prior Publication Data

US 2011/0011292 A1 Jan. 20, 2011

(30) Foreign Application Priority Data

Jan. 17, 2008 (FR) ..... 08 50291

(51) Int. Cl.

| | |
|---|---|
| ***B41F 13/24*** | (2006.01) |
| ***B41F 33/16*** | (2006.01) |
| ***B41F 33/08*** | (2006.01) |
| ***B41F 35/00*** | (2006.01) |
| ***B41F 35/02*** | (2006.01) |

(52) U.S. Cl.

CPC ..... *B41F 33/16* (2013.01); *B41F 13/24* (2013.01); *B41F 35/006* (2013.01); *B41F 35/02* (2013.01)

(58) Field of Classification Search

CPC ..... B41F 13/24; B41F 33/08; B41F 33/16
USPC ..... 101/247, 219
See application file for complete search history.

(56) References Cited

U.S. PATENT DOCUMENTS

| | | | | |
|---|---|---|---|---|
| 6,019,039 | A * | 2/2000 | Knauer et al. | 101/218 |
| 6,823,785 | B2 * | 11/2004 | Schneider et al. | 101/219 |
| 2003/0066450 | A1 * | 4/2003 | Senoo et al. | 101/425 |

FOREIGN PATENT DOCUMENTS

| | | | |
|---|---|---|---|
| DE | 44 01 275 | A1 | 1/1995 |
| DE | 198 56 906 | A1 | 6/2000 |
| DE | 100 08 936 | A1 | 8/2001 |
| EP | 0 465 789 | A1 | 1/1992 |
| EP | 0 681 915 | B1 | 11/1995 |
| EP | 0 862 999 | A3 | 9/1998 |
| EP | 1 155 857 | A1 | 11/2001 |

* cited by examiner

*Primary Examiner* — Leslie J Evanisko
(74) *Attorney, Agent, or Firm* — Davidson, Davidson & Kappel, LLC

(57) ABSTRACT

A method for successive printing of a first print job and a second print job on the same web using at least one printing group of the rotary press to print the first print job and the second print job is provided. The printing group includes at least a plate cylinder, a plate, a blanket cylinder and a blanket. Between the first print job and the second print job, a plate-changing stage occurs in which the blanket is held away from the web and the plates of the plate cylinder are changed. According to one aspect of the invention, between the first print job and the second print job, the web is kept traveling through the rotary press.

10 Claims, 3 Drawing Sheets

METHOD FOR CHANGING EDITION ON A ROTARY PRESS

The present invention relates to a process for changing edition on a rotary press.

BACKGROUND

The plates carried by the plate cylinder of each printing group determine the motif printed on the web by that printing group.

The transition from a first print job to a second print job (or change of edition) requires the changing of the plates of each printing group involved in the first print job and the second print job.

To do this, it is possible to stop the rotary press at the end of the first print job, by stopping the running of the web and the rotation of the printing groups, and to change the plates of the printing groups before restarting the rotary press for the second print job.

SUMMARY OF THE INVENTION

However, this process is time-consuming and may result in malfunctions in the rotary press requiring additional stoppages for maintenance operations. This reduces the time that the press is in use.

To that end, the invention provides a process for changing edition in which, between the first print job and the second print job, the web is kept running through the rotary press.

According to other preferred methods of implementation, the process for changing edition may include one or more than one of the following features, taken individually or in accordance with any technically possible combinations:

- during the plate-changing stage, the web is maintained at an approximately constant running speed for a predetermined period of time;
- the process includes, between the first print job and the second print job, a stage of washing the printing group, in which the blanket is held away from the web and the plates and the blanket are washed;
- the wash-up stage is performed before the plate-changing stage;
- during the wash-up stage, the printing group is driven at a different speed from that of the web;
- during the wash-up stage, the speed of travel of the web is lower than the speed of the printing group;
- prior to the wash-up stage, an ink-removal stage is performed in which the blanket is kept in contact with the web and the plates are kept in contact with the blanket, and an inking system and a dampening system of the printing group are deactivated;
- between the first print job and the second print job, the web speed is slowed down to a predetermined speed which is maintained until the second print job.

The invention also provides a rotary press including a print line including at least one printing group with a plate cylinder and a blanket cylinder, and a control unit programmed to implement a change of edition process according to any one of the preceding claims.

BRIEF DESCRIPTION OF THE DRAWINGS

The invention and its advantages will be better understood on reading the description which follows, given solely as an example and with reference to the appended drawings, in which.

DETAILED DESCRIPTION

Figure 1:
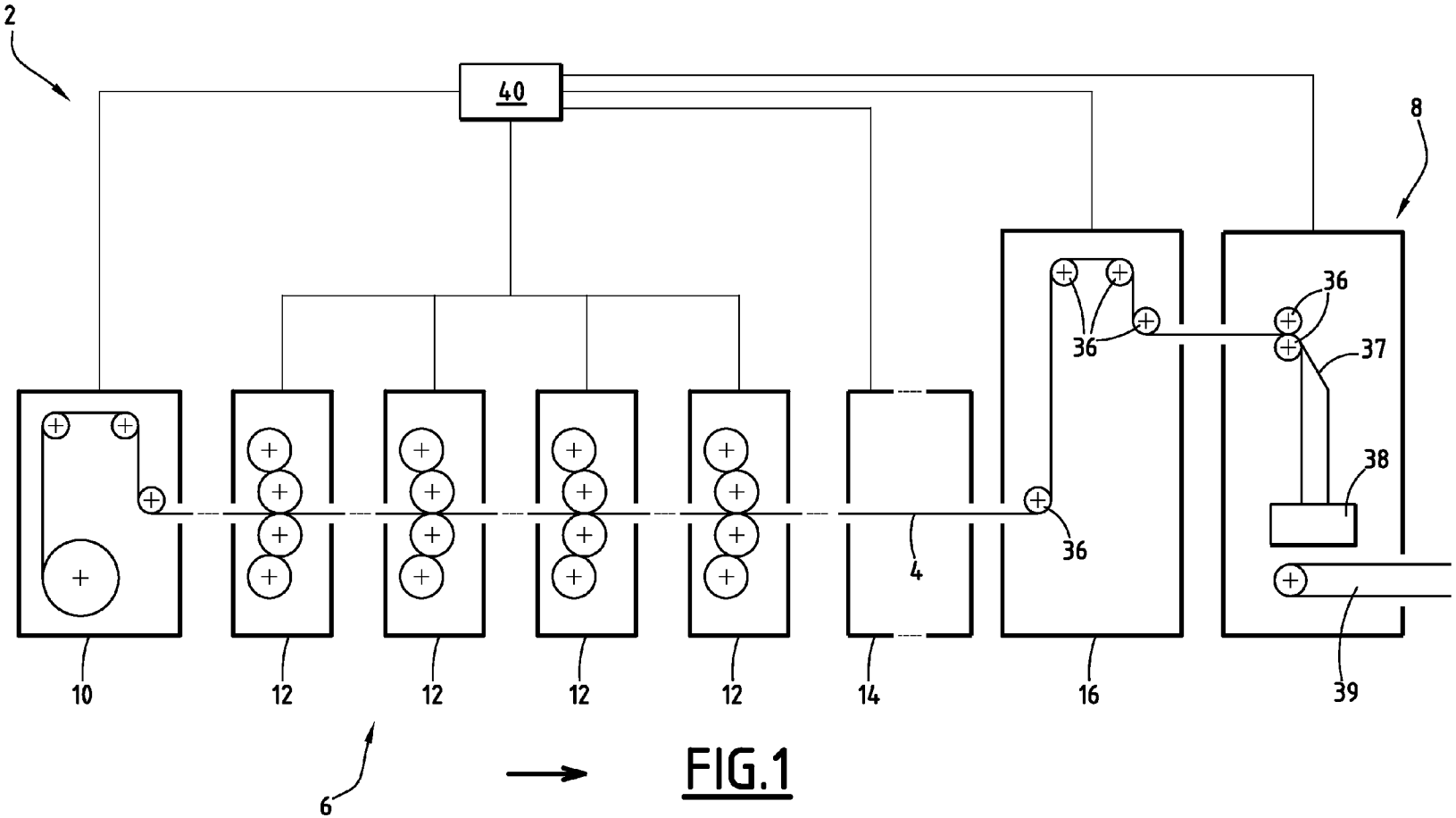
FIG. 1 is an overall diagrammatic view of a rotary press.

The rotary press 2 of FIG. 1 is intended to print webs of materials, for example webs made of paper.

The press 2 includes a print line 6 for each web 4, and a common receiving unit 8 for several webs.

Each print line 6 enables one respective web 4 to be printed.

The receiving unit 8 makes it possible to group together several printed webs in a set of webs, and to fold and/or cut the set of webs longitudinally and/or transversely, for example to form quires or signatures.

A single web 4 and the corresponding print line 6 are shown in FIG. 1.

During the printing operations, the web 4 travels through the press 2, under tension and at great speed, following a path of travel running from left to right in FIG. 1.

In the next part of the description, the terms "upstream" and "downstream" are understood in relation to the direction of travel of the web 4 in the press 2 according to its path of travel.

The print line 6 includes, from upstream to downstream, a unit 10 for unwinding the web 4 from a spool, printing units 12 for printing the web 4, a unit 14 for drying the web 4 after printing, and a unit 16 for cooling the web 4 after drying.

The drying unit 14 and the cooling unit 16 are optional.

As an option, the receiving unit 18 does not have a longitudinal folder and provides at the outlet products in the form of individual flat sheets (a "flat sheet" or "sheeter" type rotary press).

The print line 6 includes, in the example shown, four printing units 12 disposed successively along the path of travel of the web 4.

Each printing unit 12 is provided in order to print one respective color on the web 4. The four colors normally used are: black, cyan, magenta and yellow.

The printing units 12 have similar structures and functions. Only one printing unit 12 will be described in detail, with reference to FIGS. 2 and 3.

Figure 2:
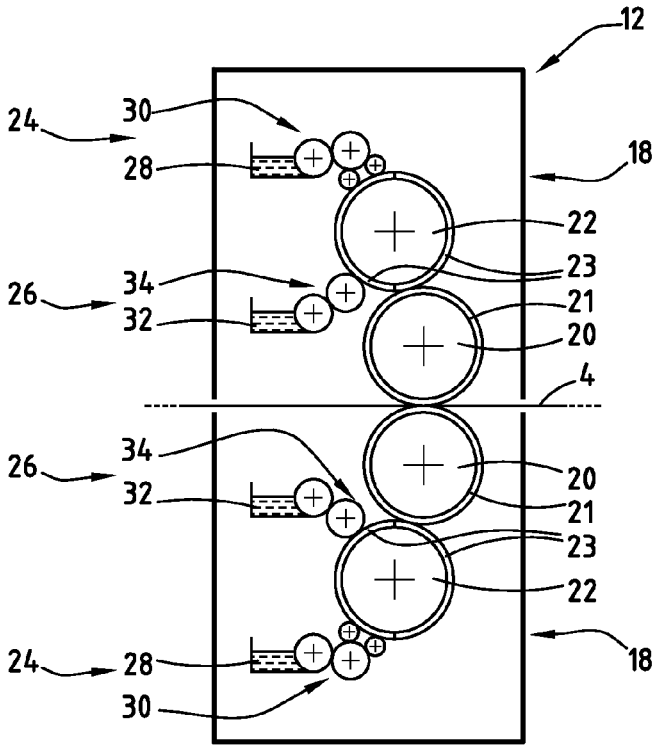
FIGS. 2 and 3 are diagrammatic views of a printing unit of the rotary press, in two different configurations.
Figure 3:
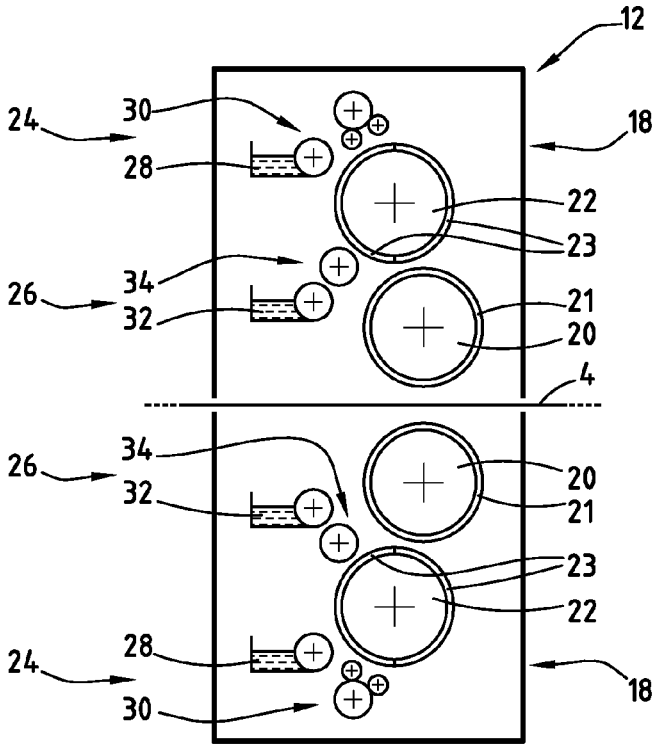

As shown in FIGS. 2 and 3, the printing unit 12 is a recto/verso printing unit. The printing unit 12 includes two printing groups 18 disposed either side of the web 4, each intended to print one respective side of the web 4.

Each printing group 18 includes a blanket cylinder 20, a plate cylinder 22, an inking system 24 and a dampening system 26.

The plate cylinder 22 (or form cylinder) carries plates 23 on which are engraved the motifs or images to be printed on the web 4.

The blanket cylinder 20 (or transfer cylinder) carries a blanket 21 intended to be in contact with the plates 23 and with the web 4, in such a way as to transfer the ink from the plates 23 to the web 4.

The inking system 24 includes an ink fountain 28 and inking rollers 30 for transferring the ink from the fountain 28 to the plate cylinder 22.

The dampening system 26 includes a dampening fountain 32 and dampening rollers 34 for transferring a dampening liquid from the dampening fountain 32 to the plate cylinder 22.

The plate cylinder 22 and the blanket cylinder 20 of each printing group 18 are moveable in a throw-on configuration (FIG. 2) in which, respectively, the blanket 21 is in contact with the web 4, and the plates 23 are in contact with the blanket 21.

In the recto/verso printing unit 12, in a throw-on configuration, the blanket cylinders 20 of two printing groups 18 clamp the web 4 between them: each forms the impression cylinder (or counter-pressure cylinder) for the other blanket cylinder 20. In a variant unit printing on one side only, the unit includes a single printing group and an impression cylinder to clamp the web against the blanket cylinder in throw-on configuration.

The plate cylinder 22 and the blanket cylinder 20 of each printing group 18 are moveable in a throw-off configuration (FIG. 3) in which, respectively, the blanket 21 is held away from the web 4 and the plates 23 are held away from the blanket 21.

It is possible to move the blanket cylinder 20 in a throw-off configuration by maintaining the plate cylinder 22 in a throw-on configuration, in order to hold the blanket 21 away from the web 4 while keeping the plates 23 in contact with the blanket 21.

In a throw-off configuration of the blanket cylinders 20, the blankets 21 are held sufficiently far away from one another that the web 4 can travel between the blankets 21 without touching them.

The dampening and inking rollers are moveable individually between a throw-on configuration enabling them to be placed in contact with one another and/or with the plate cylinder 22, and a throw-off configuration, in which this contact is eliminated.

As shown in FIG. 3, the cylinders 20, 22 and the rollers 30, 34 are in a throw-off configuration.

The movement of each cylinder or roller in a printing group 18 between a throw-on configuration and a throw-off configuration is effected in a manner known in itself, for example by fitting the cylinder or the roller rotationally around its axis at the extremities of moveable levers or on eccentrics.

As shown in FIG. 1, the cooling unit 16 and the receiving unit 8 include motorized rollers 36 for feeding the web through the rotary press 2.

The receiving unit 8 includes a device 37 for longitudinal folding of the set of webs including the web 4, a device 38 for transverse cutting, transverse folding and stapling of the set of webs, and a conveyor 39 for the quires or signatures formed by the device 39.

The rotary press 2 includes a rotary press control unit 40 to control the printing of the different print jobs by the rotary press, and in particular by the print line 6.

The control unit 40 is connected to the different units of the rotary press 2, and is programmed to implement an edition change process according to the invention, as described below.

Figure 4:
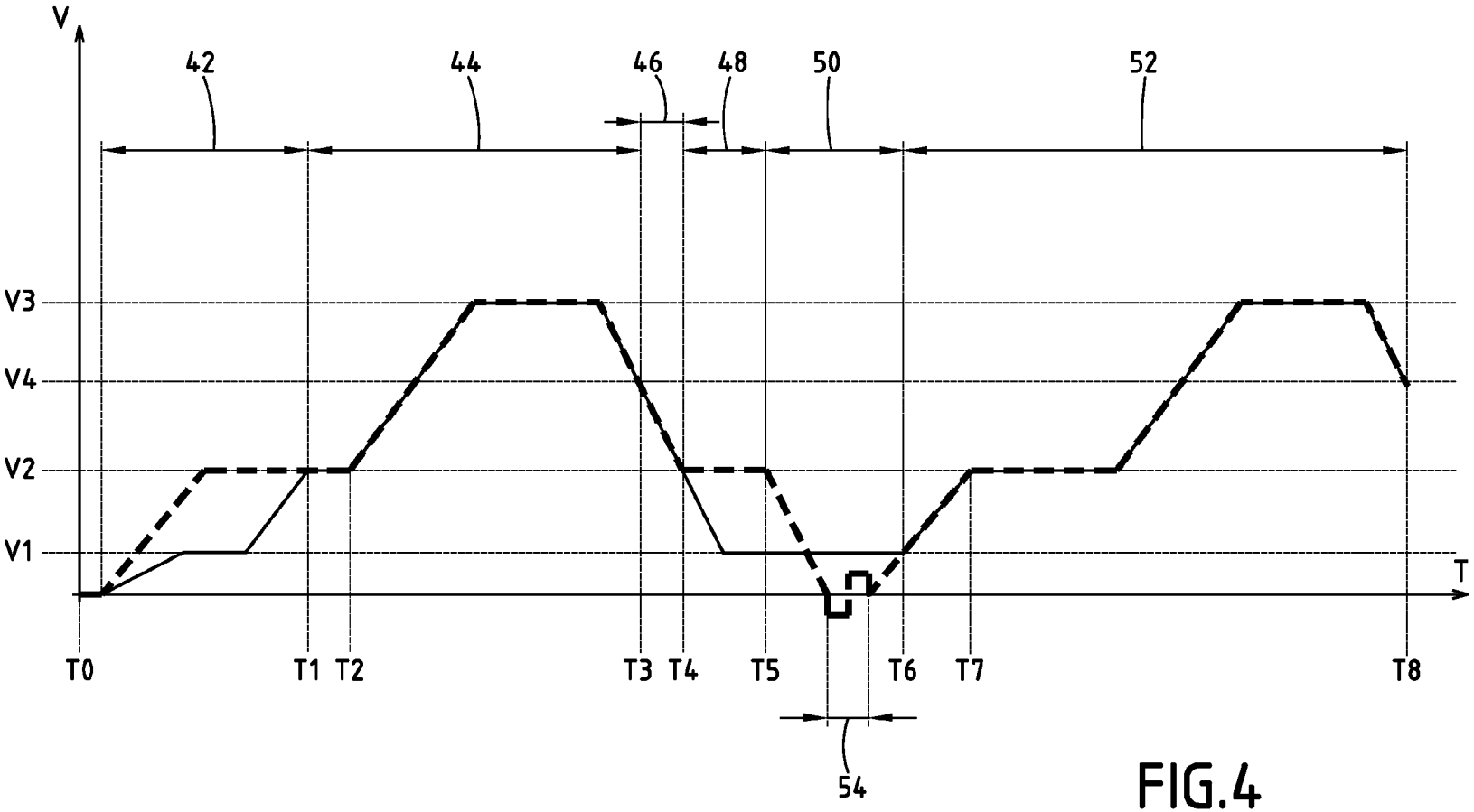
FIG. 4 is a diagram illustrating a change of edition process according to the invention using the rotary press shown in FIG. 1.

FIG. 4 is a graph illustrating a process for changing edition on the rotary press 2, for the successive printing of a first print job and a second print job on the web 4.

The graph shows the speed at which the web 4 runs through the rotary press 2 (continuous line) and the speed of the printing groups 18 of the print units 12 (dashed line) as a function of time.

Each of the print units 12 is used to produce the first print job and the second print job.

The "speed" at which the web 4 travels corresponds to the linear speed (expressed in m/s) of movement of the web 4 along its path of travel.

In each printing group 18, the cylinders and the rollers are synchronized in rotation to ensure an adequate application of ink and of dampening liquid to the plate cylinder 22, and an adequate transfer of the ink from the plate cylinder 22 to the blanket cylinder 20.

In the next part, the "speed" of a printing group 18 is understood to be the circumferential speed of the blanket 21 of this printing group, in other words, the orthoradial speed of the blanket cylinder 20 (expressed in m/s).

During printing, the speed of the web 4 must be equal to the speed of the active printing groups.

As shown in FIG. 4, the printing process includes an initial start-up stage 42, a first printing stage 44 for printing the first print job, an ink-removal stage 46, a wash-up stage 48, a plate-changing stage 50, and a second printing stage 52 for printing the second print job.

Initially, the rotary press 2 is stopped: the cylinders 20, 22 of the printing groups 18 are in a throw-off configuration, and the printing groups 18 and the web 4 are immobile.

The start-up stage 42 takes place between a time T0 and a time T1.

During the start-up stage 42, the printing groups 18 are accelerated until the printing groups 18 reach a slow running speed V2 maintained for a certain period of time. The inking of the printing groups 18 is initiated in order to distribute the ink as uniformly as possible over the plates 23 and the blankets 21 of the printing groups 18.

Simultaneously, the web 4 is accelerated to a slow speed of travel V1, and maintained at that speed for a predetermined period of time, then accelerated to the speed V2 which it reaches at time T1.

The web 4 is maintained at the speed V1 for a period of time sufficient for satisfactory inking of the plates 23 and the blankets 21 of the printing groups 18.

At the end of the start-up stage, the printing groups 18 and the web 4 are thus at the same speed V2, which allows the first print stage 44 to start by placing the printing groups 18 in a throw-on configuration at time T1.

The first printing stage 44 takes place between time T1 and a time T3.

The first printing stage 44 includes a first adjustment phase between time T1 and a time T2, during which the printing groups 18 and the web 4 are maintained at the speed V2 for the time required to carry out any adjustments (color, side register, length register).

The first printing stage 44 includes a second printing phase between time T2 and time T3, during which the web 4 and the printing groups 18 are accelerated in a synchronized manner until they reach a nominal production speed V3 maintained for a period of time sufficient for the production of the desired number of copies.

As shown in FIG. 4, the first printing stage 44 includes a final optional phase of slowing down the printing groups 18 and the web 4 to a speed V4, between speed V3 and speed V2, before the start of the ink removal stage 46.

The ink removal stage 46 takes place between time T3 and time T4.

During the ink-removal stage, the inking systems 24 and dampening systems 26 of the printing groups 18 are deactivated, for example, by placing certain rollers of these systems in a throw-off configuration, and the cylinders 20, 22 of the printing groups 18 are maintained in a throw-off configuration in such a way as to eliminate a part of the ink remaining on the plates 23 and the blankets 21 on the web 4. The part of the web 4 printed during this stage is generally not of adequate quality.

Simultaneously, the printing groups 18 and the web 4 are slowed down in a synchronized manner to speed V2, reached at time T4.

The wash-up stage 48 takes place from time T4 to a time T5.

During the wash-up stage 48, the cylinders 20, 22 of the printing groups 18 are initially moved into a throw-off configuration, and the printing groups 18 are maintained at speed V2 while being washed, for example and in a known manner by projecting appropriate washing liquids, such as a solvent, onto the plates 23 and the blankets 21.

Simultaneously, the web 4 is slowed down to speed V1 and is maintained at this speed V1 during the washing of the printing groups.

The plate-changing stage 50 takes place between time T5 and time T6.

During the plate-changing stage, the printing groups 18 are slowed down until they are halted, then the plates 23 of the printing groups 18 are changed during a plate-change phase 54, then the printing groups are accelerated.

The crenel shape of the curve showing the speed of the printing groups during the plate-changing phase 54 illustrates the possible movements of the printing groups 18 necessary to orientate each plate cylinder 22 adequately around its axis with a view to the changing of the plates 23.

The changing of the plates 23 of each plate cylinder 22 is performed manually, or, in a known manner, automatically.

During the plate-changing stage 50, the web 4 is maintained at speed V1.

When the blanket cylinders 20 of the printing groups 18 are in a throw-on configuration, the blanket cylinders 20 help to keep the web 4 under tension and traveling through the rotary press.

When the blanket cylinders 20 of the printing groups 18 are in a throw-off configuration, the web 4 is kept under tension and fed through the print line 6 by the feed rollers of the units of the rotary press 2 that are disposed downstream of the print units 12, in particular the rollers 36 of the cooling unit 16 and the reception unit 8.

The second stage of printing 52 takes place between time T6 and a time T8.

The second stage begins as soon as the printing groups 18 have reached speed V1. The second printing stage includes a first adjustment phase, in which the web 4 and the printing groups 18 are accelerated to speed V2 which is maintained for a period of time necessary for any adjustments, and then, from a time T7, a second printing phase, in which the web 4 and the printing groups 18 are accelerated to speed V3 which is maintained for a period of time sufficient to obtain an adequate number of copies.

In a variant, the first adjustment phase of the second printing stage is effected in a manner similar to that of the first printing stage, with an acceleration to speed V2 in two stages, firstly, acceleration of the printing groups for inking-up, then an acceleration of the web 4 to speed V2 to synchronize it with the printing groups.

After the second printing stage, the process may include a third printing stage, in which case there will be implemented ink removal, washing and plate-changing stages similar to those described previously, or a stage of stopping the rotary press 2, if the print jobs are completed.

Thus, in accordance with the invention, the web is kept running without interruption between the two successive print jobs on the same web, both print jobs being performed using at least one common printing group, with a change of plate of the printing group between the two print jobs.

Maintaining the movement of the web between the two successive printing stages enables the second print job to start more quickly because it avoids having to restart movement of the web.

Furthermore, it is usual for restarting the web to lead to jamming in the units situated downstream from the print units, or to breaks in the web.

Maintaining the movement of the web between the two successive printing stages avoids these jams and these breaks, and also the maintenance operations which result therefrom.

Maintaining the movement of the web but at a low speed V1, in particular, a lower speed than the speed V2 of the printing groups for example during the washing stage, avoids wasting a large quantity of material.

In the embodiment shown, the print line 6 includes four active print units in each of the printing stages. In a variant, the print line may contain a larger number of print units, only some of them being active in both printing stages. Thus there may be some print units that are active in one stage and inactive in the other.

What is claimed is:

1. A method for changing edition on a rotary press, for successive printing of a first print job and a second print job on the same web, the rotary press including a plurality of printing units, each printing unit including a plate cylinder, plates, a blanket cylinder and a blanket, the method comprising the steps of:

printing the first print job on the web with the plurality of printing units;

holding each blanket cylinder away from the web while the plates of each plate cylinder are changed during a plate-changing stage, the plate-changing stage occurring between the first print job and second print job;

moving the web through the rotary press between the first print job and second print job during the plate-changing stage so the web keeps traveling through the rotary press between the first print job and the second print job; and printing the second print job on the web with the plurality of printing units, the first print job and the second print job being printed on the web successively with the web not being printed on by any printing units of the rotary press between the first print job and the second print job.

2. The method for changing edition according to claim 1, wherein during the plate-changing stage, the web is maintained at an approximately constant running speed for a predetermined period of time.

3. The method for changing edition according to claim 1, further comprising the step of holding the blanket away from the web while the plates and the blanket are washed during a wash-up stage, the washing stage occurring between the first print job and the second print job.

4. The method for changing edition according to claim 3, wherein the wash-up stage is performed before the plate-changing stage.

5. The method for changing edition according to claim 3, wherein during the wash-up stage, the printing group is driven at a different speed from that of the web.

6. The method for changing edition according to claim 5, wherein during the wash-up stage, the speed of travel of the web is lower than the speed of the printing group.

7. The method for changing edition according to claim 3, further comprising the step of maintaining contact between the blanket and the web and maintaining contact between the plates and the blanket while an inking system and a dampening system of the printing group are deactivated during an ink removal stage, the ink removal stage occurring prior to the wash-up stage.

8. The method for changing edition according to claim 1 wherein the step of moving the web includes keeping the web running without interruption.

9. A method for changing edition on a rotary press, for successive printing of a first print job and a second print job on the same web using a plurality of printing units of the rotary press to print the first print job and the second print job, each printing unit including a plate cylinder, plates, a blanket cylinder and a blanket, the method comprising the steps of:

printing the first print job on the web with the plurality of printing units;

holding each blanket cylinder away from the web while the plates of each plate cylinder are changed during a plate-changing stage, the plate-changing stage occurring between the first print job and second print job;

moving the web through the rotary press between the first print job and second print job during the plate-changing stage so the web keeps traveling through the rotary press between the first print job and the second print job; and printing the second print job on the web with the plurality of printing units, the first print job and the second print job being printed on the web successively with the web not being printed on by any printing units of the rotary press between the first print job and the second print job wherein between the first print job and the second print job, the web speed is slowed down to a predetermined speed which is maintained until the second print job.

10. A method for changing edition on a rotary press, for successive printing of a first print job and a second print job on the same web using a printing line of the rotary press to print the first print job and the second print job, the printing line including four printing units, each printing unit including a plate cylinder, plates, a blanket cylinder and a blanket, the method comprising the steps of:

printing the first print job on the web with the four printing units;

holding each blanket cylinder away from the web while the plates of each plate cylinder are changed during a plate-changing stage, the plate-changing stage occurring between the first print job and second print job;

moving the web through the rotary press between the first print job and second print job during the plate-changing stage so the web keeps traveling through the rotary press between the first print job and the second print job; and printing the second print job on the web with the four printing units wherein the first print job and the second print job are printed on the web successively with the web not being printed on between the first print job and the second print job by any printing units of the rotary press.

* * * * *